US005937592A

United States Patent [19]

Tamlyn

[11] Patent Number: 5,937,592

[45] Date of Patent: Aug. 17, 1999

[54] VENT STRIP

[76] Inventor: John Thomas Tamlyn, 10406 Cash Rd., Stafford, Tex. 77477-4492

[21] Appl. No.: 09/072,306

[22] Filed: May 4, 1998

Related U.S. Application Data

[63] Continuation of application No. 08/852,632, May 7, 1998, Pat. No. 5,799,446, and a continuation of application No. 08/862,576, May 23, 1997, Pat. No. 5,881,502.

[51] Int. Cl.[6] ..... E04B 7/00

[52] U.S. Cl. ..... 52/95; 52/302.3; 454/260

[58] Field of Search ..... 52/94, 95, 96, 52/302.1; 454/260

[56] References Cited

U.S. PATENT DOCUMENTS

| | | | |
|---|---|---|---|
| 4,189,878 | 2/1980 | Fitzgerald | 52/94 X |
| 4,195,455 | 4/1980 | Chalmers et al. | 52/94 |
| 4,461,128 | 7/1984 | Knoebl | 52/94 |
| 5,718,086 | 2/1998 | Dunn | 52/94 X |

*Primary Examiner*—Creighton Smith
*Attorney, Agent, or Firm*—Gunn & Associates P.C.

[57] ABSTRACT

A soffit construction is set forth for use under the eave of a roof overhang on a building. A lengthwise soffit board (one or more serially arranged) are placed parallel to and at the top end of the outside wall under the cave. There is a first outside soffit board which is parallel to an inside soffit board. The two boards in series are arranged to define a gap. The two soffit boards define parallel edges to enable a vent strip to be snapped between the two edges. The vent strip engages the board's edges to position a covering in the gap with a set of perforations there to enable air flow up into the roof for ventilation purposes.

30 Claims, 2 Drawing Sheets

VENT STRIP

This disclosure is a continuation of Ser. Nos. 08/852,632 filed May 7, 1998 and 08/862,576 filed May 23, 1997, and issued as U.S. Pat. Nos. 5,799,446, and 5,881,502.

BACKGROUND OF THE DISCLOSURE

This disclosure is directed to a new construction for soffits which are installed under the eaves in residential housing. In the construction of a residential house, the rafters and joists positioned above the house define an attic space which is ventilated by circulation in the attic area. While there are turbine ventilators installed on the roof eave vents, gable louvers and other devices to exhaust hot air from an attic, an equally important aspect of attic circulation is obtained by intake air movement through the soffit. The soffit is the region under the eave which is normally closed. In the past, they have been closed by thin boards such as ½" or ¾" boards. One improvement in the soffit has been the incorporation of gaps in the soffit which are closed by screen wire. An even larger improvement has been implemented in the past such as positioning a plastic strip over the gap in the soffit. The plastic strip is typically perforated to provide breathing. Over time, the availability of wood which readily accepts either small nails or staples has decreased. Particle board and other composite materials have been substituted. This makes a better, longer lasting soffit in the sense that the composite board is typically more weather resistant and less likely to rot or decay with time. Even better products have been provided for that which have even longer life when exposed to weather. One such device is a fiber-cement soffit board. Fiber-cement is a material which provides a low maintenance product which is not combustible, is moisture resistant, will not rot, and is not susceptible to insect attack by termites. It is a quality product and is able to replace wood without warping, rotting or bending over a 50 year life. One maker of this product provides a 50 year warranty. There are difficulties, however, with fiber-cement boards. It is not readily possible to drive a nail, staple or screw through such a board and develop a grip between the nail and board. It is also difficult to make a staple hold permanently. Therefore, the soffit board formed of fiber-cement is not so readily integrated in the structure. To install a breathing strip next to such a soffit board, and especially one made of fiber-cement, it is easier to install a clip mechanism. This avoids the necessity of finding a rafter on the blind side of the fiber-cement board and driving a nail through the fiber-cement soffit board and then into the rafter. Moreover, the apparatus of the present disclosure enables construction of a soffit under the eave of any length and width deemed appropriate. This enables consecutive boards to be anchored under the eave to extend the eave to any length, for instance, 50' or 100' in length. In that example, the soffit is fabricated in place under the eave by placing precut fiber-cement soffit boards on the eave, defining a gap between two runs thereof, and extending the runs of soffit boards along the eave length. If, for instance, the stock boards are provided in 12' lengths, an eave of 50' will require four full-length soffit boards and a short one which is cut to size to complete the 50' length. Each soffit board is installed end to end to accumulate the 50' length. A 50' gap between two parallel soffit boards is created. For easy nomenclature, the two soffit boards are defined simply as the inside and outside soffit boards. The inside soffit board is adjacent to the wall of the building while the outside soffit board is parallel but more remote to the inside soffit board. The gap between the two is the breathing space.

Normally, the inside and outside soffit boards are butted together to define the length of the soffit board. The butt joint is not a load bearing joint but it typically is not an easily sealed joint. Rather, it is simply the butt located gap between one board and another. Heretofore, it has been necessary to plug that gap. A common technique for doing this is injecting a semisoft adhesive into the gap with a caulking gun. The caulking material is pumped into the gap and cures somewhat to provide a tacky or adhesive seam material.

The caulking material prevents air flow in that area and also seals out moisture, insects, etc. It is not a load transferring joinder material. It simply plugs the gap between the butt ends of adjacent boards. Moreover, the caulking material pumped into the gap accommodates misalignment readily within a range. Misalignment and gapping which might arise by settling of the house, however, may pose a problem. Where the gap becomes smaller, the caulking material can stay put. Where the gap is pulled wider, over time, the caulking material may fail. Where the gap is irregular, the caulking material may provide an adequate seal where the gap is narrow but an inadequate seal where the gap is wider. Caulking material is initially soft and can be worked easily. Over the years, it dries and cracks with aging and drying. This time dependent deterioration is detrimental to the use of caulking.

In the past, prefabricated soffit breathing strips of aluminum wire screen and surrounding rectangular frames have been attached by nailing or stapling. One advantage of aluminum is that it forms a protective oxide layer, avoiding the need of painting or putting some sort of protective coating on it. In this instance, direct contact of aluminum to the cement based products seems to create some sort of undesired reaction at the contact area. While no chemical analysis has been made it seems to form a localized skin blemish on the cement based board on wall covering product.

It is desirable that the completed soffit area be made substantially without requiring a lot of measurements. The present apparatus sets out a system by which this can be accomplished. The breathing space under the eave is assured through the use of the present disclosure. This disclosure thus sets forth a fabricated soffit assembly which is made in place. It features an inside soffit board formed of two or more lengths of soffit board material. While wood (more often, plywood) is one embodiment, the present invention especially contemplates the use of improved soffit products including particle board but especially also including fiber-cement soffit panels. Again, while it will work successfully even with plywood or other nonwood members, it finds its ultimate and best mode of assembly and greatest life in making the soffit with fiber-cement products. So, it is best described as a soffit assembly having an inside soffit board made up of two or more butt joined boards, an intermediate gap which is the breathing space, and the outside soffit board which is assembled in the same fashion as the inside soffit board. The present invention further contemplates the installation of an elongate strip between the inside and outside soffit boards. It clips to the adjacent soffit boards. There are left and right edge located U-shaped receptacles along the length of the vent strip. The vent strip spans the open gap and is wider than it, thereby snapping in place and requires no nails or staples to maintain the installed position. A cross strip is installed at the end of individual soffit boards. The cross strip has a H-shaped profile, and is installed across the width. The cross strip thus provides continuity, replacing the caulking and caulking gun, and thereby closing the attic space to assure that controlled ventilation is achieved through the soffit assembly of the present disclosure. Moreover, it can be installed and left in position for the duration or life of the building. The finished installation features aesthetically attractive seams.

Summarizing the present invention, it comprises an assembled soffit under an eave which is made of an inside soffit board and an outside soffit board, and each of the two is preferably assembled from composite materials having the form of sheet or decking material and extending to any desired length. The length is accommodated by installing two or more boards serially. A central gap is left and is filled by a vent strip, to be described, which snaps in place. A cross strip is also installed at the ends of individual soffit boards to protect at that joint. The vent strip and cross strip are fabricated as extrusions and are relatively inexpensive, easy to manufacture, durable when installed, can be installed with a minimum of hand labor and do not require the use of screws, bolts, nails, staples or other fasteners.

The present disclosure is summarized as a vent strip for attachment to an exposed eave. It is formed of an extruded continuous profile of plastic material having a profile enabling easy installation without screws, staples or nails. On one edge, it is provided with an L-shaped bracket which overhangs the veneer attached to the exterior of a building (e.g., the brick frieze strip). This enables easy installation at the topmost level of the veneer. The center portion is a wide span having a set of formed holes in it to provide breathing. The aggregate cross-sectional area is quite large, thereby furnishing the necessary breathing area. At the marginal right edge, it is constructed with a locking channel having three sides. The channel has a width and height sufficient to lock snugly against the soffit board. Multiple strips can be installed serially to provide a ventilation breathing space along the entire eave of a residential construction.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may add to other equally effective embodiments.

DETAILED DESCRIPTION OF THE PREFERRED EMBODIMENT

Figure 4:
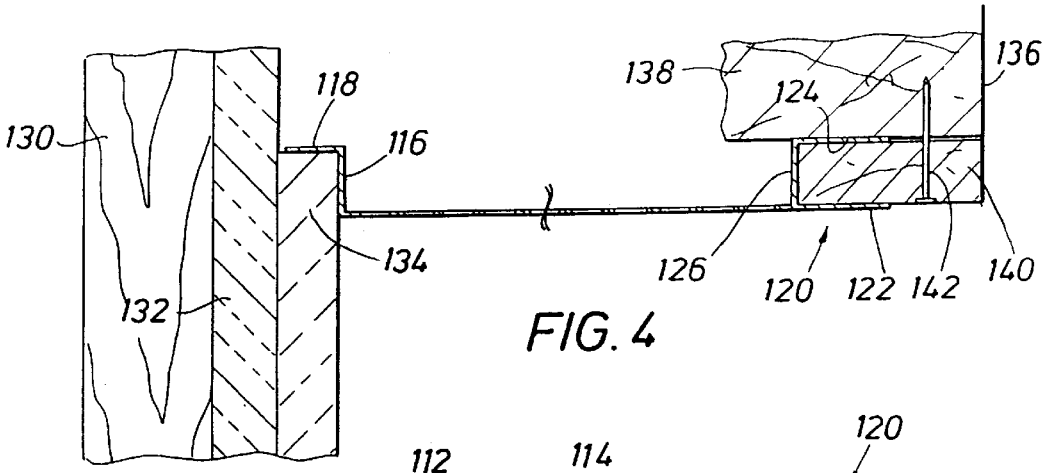
FIG. 4 is a sectional view of the vent strip of the present disclosure installed under an eave adjacent to a veneer building finish.
Figure 5:
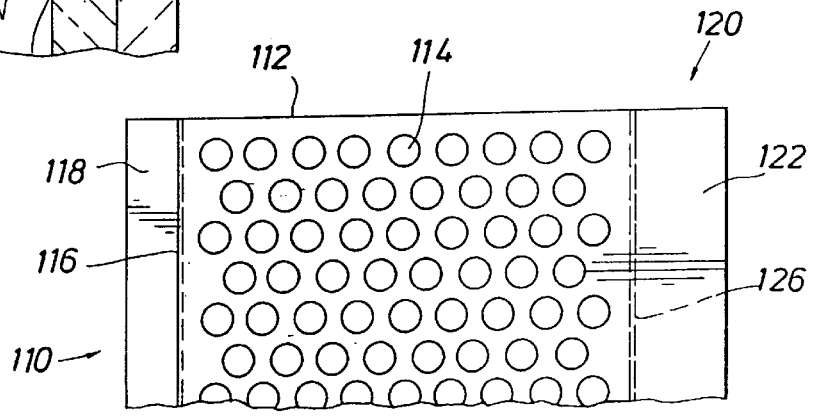
FIG. 5 is a bottom view looking up at the vent strip of FIG. 4 which shows the breathing spaces in the vent strip.
Figure 6:
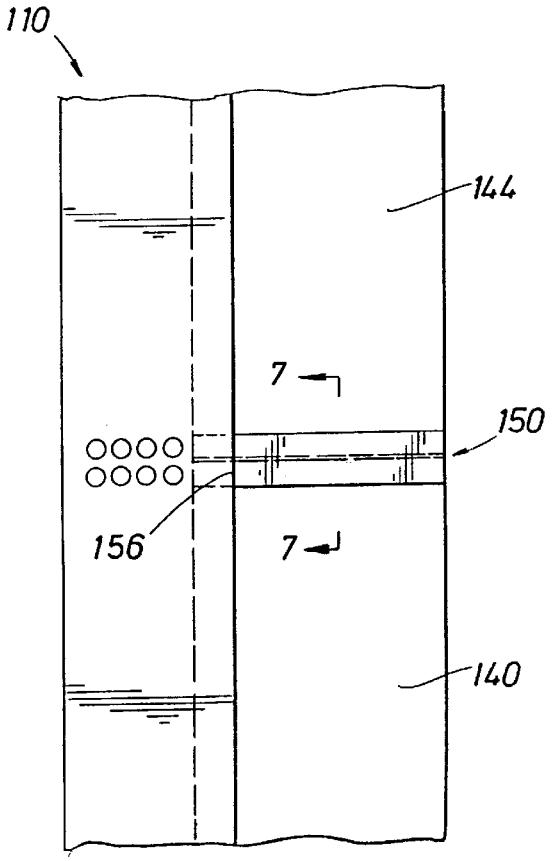
FIGS. 6 and 7 show two abutting soffit boards cooperative with the present vent strip.
Figure 7:
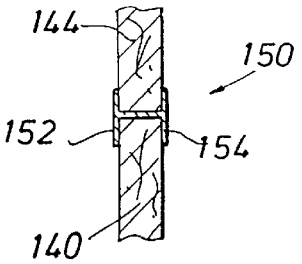

Attention is now directed jointly to FIGS. 4 and 5 which show the ventilation strip 110 of the present disclosure. The strip 110 is shown alone in FIG. 5 while it is shown installed in FIG. 4. The installation of FIG. 4 provides the context or its location. That will further enhance the explanation of the structure of the ventilation strip. Briefly, going to the strip itself, it is constructed in specified widths and indefinite lengths. A representative width includes a vent area of about 2" with marginal edges making a total strip width of about 3" or so. That particular embodiment likely will find substantial commercial significance. The ventilated area of about 2" in width is flanked on the marginal edges by widths of something more than ¼" ranging up to about ⅜" or even ½" depending on the size of the edges. More specifically, the strip includes a central area 112 which is provided with a number of perforations 114. The perforations can be relatively uniform and are arranged in rows and columns. While round is shown, other shapes such as squares or diamonds are useful. The perforations remove in the range of 40% to 65% of the surface area so that that much breathing area is provided. The perforations are located only at the center planar portion 112. The strip is constructed with a veneer shoulder meaning a shoulder on the left which is adapted for locking over (1) the veneer finish on the building wall, (2) the brick frieze strip, or (3) the framing member of the wall. This shoulder includes a wall 16 perpendicular to the plane of FIG. 5. This shoulder 116 is also shown in FIG. 4. A top lip 118 is located at the edge of the shoulder 116 to reach over the veneer as will be explained in detail with a representative installation. In cross-sectional view as shown in FIG. 4, they define an L-shaped latching member. This holds one edge of the equipment in place.

The right side of the ventilation strip 110 is defined by a U-shaped receptacle. This receptacle 120 is defined by three side walls. The three walls include the visible wall 122 shown in FIG. 5, the parallel wall 124 shown in FIG. 4, and the transverse wall 126. The shoulder 126 is at right angles to the walls 122 and 124. The shoulder 126 is parallel to the shoulder 116. It is desirable, but not required, that the shoulders 116 and 126 be formed with a common height.

The spaced shoulders 116 and 126 both serve as a butting shoulders. They define the width of the ventilation area. Moreover, they are adapted to be contacted against components of the structure which will be detailed in FIG. 4. The ventilation strip 110 is typically formed of extruded vinyl and has a length which is specifically long enough. The length is adequate in length so that one or more units of the ventilation strip 110 can be installed under an eave. They are simply deployed end-to-end in putting the eave structure together. The ventilation strip is preferably formed of an extruded vinyl having the illustrated cross-section and is perforated while being extruded. Typically, the thickness is a few mils, ranging typically from about 3 mils to about 12 mils in thickness. If the ventilation area is about 2" in width, the aggregate width is somewhere between about 2.5 and 3.0". A larger version can be made and if the width is increased, it is ideal to increase slightly the thickness to provide enhanced stiffness. It is desirable that the strip be able to flex or bow when squeezed between the two edges. That will be explained in regard to the installation of the strip. The strip is formed of a uniform colored material such as light tan, eggshell white, or perhaps some other off white. Also, gray will suffice. Generally, the vent strip is extruded of vinyl plastic mixed with a pigment or dye in the feed. This provides a color all the way through the extruded plastic. In the alternative, the strip can be extruded with one color and coated with other colors. It is normally installed at an area on a residential construction where it is seldom noticed. While not conspicuous to visual inspection, it is nevertheless exposed for viewing and it maintains its color, shape and decorative nature throughout an extended installation of 20 years or more. Because it is not exposed directly to sunlight, and is not exposed to the ultraviolet rays from the sun, aging, having the form of minor cracks accompanied by embrittlement, is less likely to occur. In reality, some of that may be reflected from the earth's surface and back scattered against the strip which might cause very slow aging. Even, however, with aging, the strip can maintain a quality ventilation area in an eave without requiring replacement for many years. Generally, plastic surfaces, exemplified by PVC and many other plastics, are susceptible to ultraviolet radiation which cracks the plastic. Paint reduces radiation damage. Generally, metal screen strips do not last that long through oxidation, etc. Moreover, the strip is also easier to clean once installed. It typically can be brushed with a broom.

Going now to FIG. 4 of the drawings, FIG. 4 shows the context in the construction of a building. The sequence of the building assembly may differ. This may also change the time at which the strip is fastened to the partially finished building. From the left side of FIG. 4, the numeral 130 identifies a typical vertical framing member. Commonly, this is a 2×4 which is erected on spaced centers, typically ranging between 16" and 24" spacing. It is erected to define the outside wall of the building. After that, the outside is commonly covered by 4×8 sheets of some sort of covering material 132, e.g., plywood, Styrofoam, composite sheets, etc. Typically, this is a sheet of insulative material. The amount, thickness, and precise nature varies depending on the climate and the amount of insulation required. It is, however, installed after the framing. The framing is thus clad in this material. At some point in the construction of the building, an exterior building veneer is attached. The veneer can comprise any number of covering materials including cedar shingles, horizontal wood planking, vertical wood planking, a brick veneer of a selected thickness, and other covering materials. Fiber-cement materials are also used. The veneer material is typically added in rows or planks moving from the bottom toward the top of the wall. The topmost course 134 of the veneer can typically be, as mentioned, one of those products. The veneer member 134 is near the top of the wall, normally at the top or overlapping and exposed along the overhang. The important aspect of this particular installation is that the veneer material is extended up the wall and extends into the region of the eave so that it covers the wall. The underside of the overhang or the soffit region of the eave is at right angles to the topmost course of the veneer 134. Assume, for purposes of discussion, that the veneer material is a course of veneer bricks which are 1" in thickness. Again, this is representative and is not meant to limit. The topmost course of bricks 134 is attached in the common fashion. Again, if wood planking, it is attached by placing nails through the veneer 134 and into the frame member 130. Without regard to the precise details regarding fabrication, the topmost veneer member 134 is affixed and defines an upwardly facing shoulder which is used to support the L-shaped mounting bracket along the edge. As shown in FIG. 4 and ultimately accomplished in installation, the shoulder 116 butts up against the veneer and the offset left marginal edge 118 is latched or portioned marginally over the top of the veneer. More will be given regarding that.

The residential construction typically places a roof with an overhang extending well beyond the veneer 134. The overhang is defined by an outer facia surface 136. The surface 136 is typically spaced perhaps 8" to 24" from the veneer 134. This overhang keeps direct rain from falling against most of the wall. This enhances the life of the veneer material. This reduces air conditioning costs by shading the windows. It reduces or delays weathering of the plastic strip significantly. The facia board 136 is constructed at the outer ends of the rafters (not shown) defining the pitch of the roof and is the terminal end of lookout boards. The several lookout boards are arranged parallel to one another and at right angles to the ledger which are part of the house frame. It is common to assemble the joists and rafters at the time of framing the house, i.e., at the time of erecting the frame members 134. This enables several different craftsmen to have access so that they can work on the house simultaneously. In part, it is somewhat dependent on the climate, namely, whether the inclement weather and rain pose a problem, but it is not uncommon that the joists 138 and the rafters defining the roof are placed on the framed building quickly so that some kind of roof covering material can be placed as quickly as possible. That is placed on the house so that it is weathered in, i.e., the open framed building, even without wall covering, can shelter workmen who are out of the elements at the time. In any event, the eave, defined by the roof overhang, is constructed with the rafters and joints 138 in place. One step of this fabrication sequence is to then attach the soffit board 140. In this particular instance, the width of the soffit board can vary and it is shown with a broken line to indicate that it can be quite narrow or much wider. The soffit board is not a load bearing board. It is provided primarily to seal the eave area so that the roof and attic area are isolated to prevent small animal entry. Also, the soffit enhances appearance. The soffit board, therefore, need not be a heavy framing member. Rather, it is typically a thin sheet. Typically, it can be formed of particle board, plywood or the fiber-cement combination material previously mentioned. That typically will define a soffit of about ½" in thickness or less. An optimum is in the range of about ¼" thickness. That thickness is noteworthy because the thickness of the soffit 140 is related to the shoulder 126 on the vent strip 110. Ideally, the soffit 140 matches the thickness of the shoulder 126. The soffit board (two or more butting boards) is nailed to the lookout 138. A typical nail is indicated at 142. It is nailed to hold the soffit 140 in place. In view of the fact that it is light weight material because it is relatively thin, one or two courses of nails along the soffit driven into the overhead joists 138 is sufficient to hold the soffit in place. The nails or fasteners must comply with the building code for the locale. Ideally, the soffit is nailed to the lookout 138 so that there is a slight gap left between the soffit 140 and the overhead lookout 138. It is necessary to insert the lip of edge 124 of the receptacle 120 into the gap above the soffit 140 and below the lookout 138. If the lookouts are nailed too close to the soffit edge, they will tend to pinch or clamp against the vent strip 110 when it is installed and may prevent installation. Shim stock in the form of flat sheet stock is typically installed between the two. Alternatively, the nail 142 is driven home but it is not provided with the final blow which closes the soffit snugly against the lookout 138. The best nailing approach involves placing nails through soffit board into the lookout closer to the facia than the vent strip. In some instances, the soffit may be attached with pneumatically driven staples. In that instance, it is optimum to place perhaps two rows of staples in the soffit board. One row of staples can be placed adjacent the facia 136, and the second row can be fastened in the soffit 140 after installation of the vent strip 110. That will help snug up the fit between the soffit 140 and the lookout 138. Again, this is a matter of technique and it can be varied from craftsman to craftsman (or region to region) to accomplish the desired result.

The soffit board is spaced in width from the veneer or frieze strip 134. The edge of the soffit 140 defines the gap or space which is to be filled by the vent strip 110. This space is therefore made uniform along the eave of the house. This requires that the soffit board be cut to the specified width. As shown in FIG. 4, the soffit is broken in the view so that it will be understood that the actual width of the soffit 140 can vary. Again, this is a matter of design and can be accommodated by the vent strip 110 of the present invention. At the time of installation, the vent strip is conveniently bowed by hand as the receptacle 120 is clamped against the edge of the soffit 140. This is done along the edge of the entire strip. Thereafter, the left hand edge is pushed up and over the veneer or frieze strip 134. It will be easy to see when the vent strip snaps into place to the illustrated position of FIG. 4. It is able to flex and bow in curvature. While bowed, the left and right edges which accomplish attachment are aligned so that the vent strip 110 can be moved into the position which is ultimately accomplished in FIG. 4. It is typically attached by attaching one edge completely and then attaching the other edge. It may be more desirable to attach the left edge first, not the right. In other installations, it may be desirable to do the right edge first. Once attached and snapped into place, nothing further is required of the vent strip. In typical construction sequences, it may, at that time, be desirable to put another row of nails or another row of staples in the soffit board 140. Again, this is a sequence of construction which can be varied depending on the desires of the craftsmen. The soffit board has a length, as mentioned, which can be the length of the building. Likewise, the vent strip 110 can be installed in multiple units. If furnished in 8' lengths, they can be installed serially. Odd lengths can be accommodated simply by using a pair of tin shears to cut the vent strip to any desired length.

When finished, a ventilation into the attic area is provided. The holes 114 provide more than adequate breathing space. This ventilation is important to the operation of the house and seems to provide enhanced life to attic and roofing materials. Moreover, ventilation through the vent strip 110 is accomplished with the benefit of an attractive under eave construction. Such attic ventilation extends life so much that many shingle makers require attic air ventilation.

Figure 1:
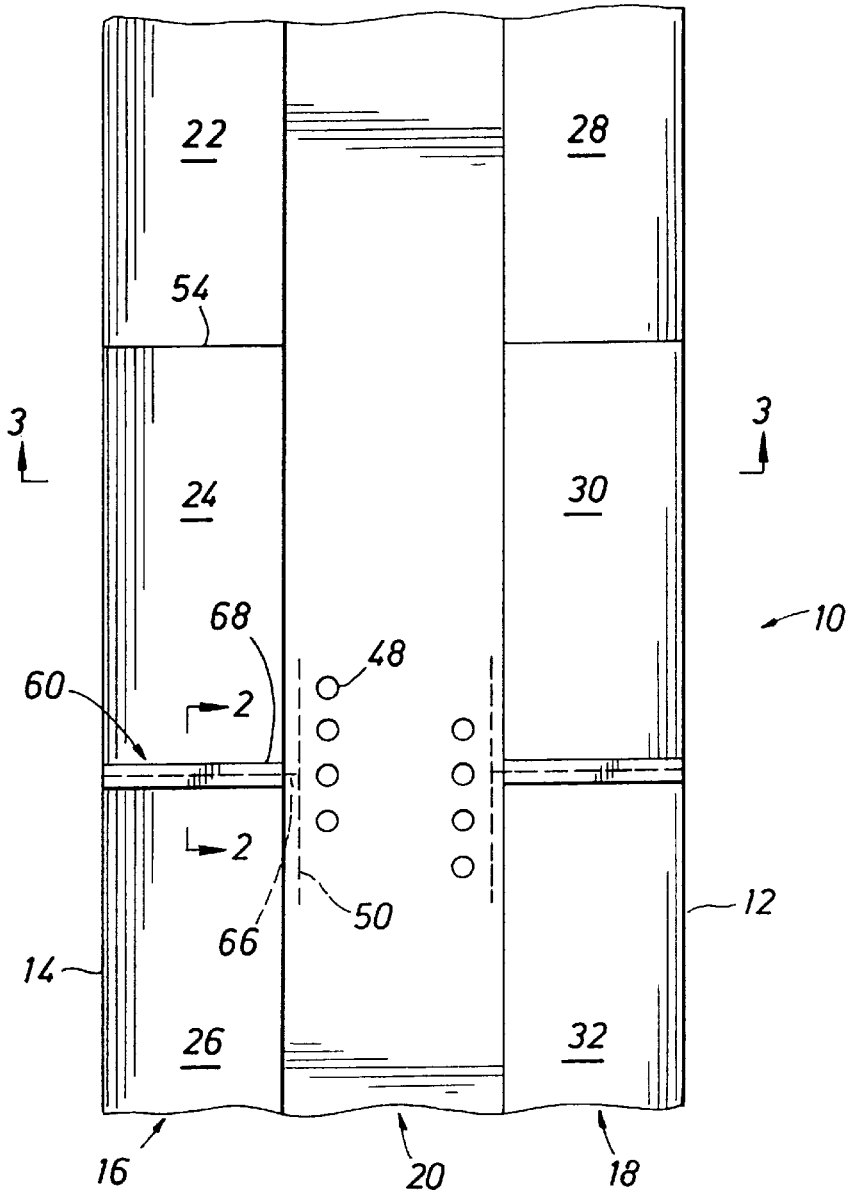
FIG. 1 is a bottom view of a soffit looking up at the soffit and showing parallel inside and outside soffit boards defining a gap therebetween wherein a vent strip is installed in the gap to provide breathing into the attic.
Figure 2:
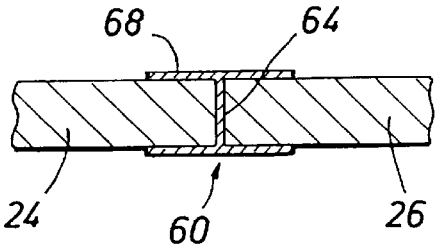
FIG. 2 is a sectional view along the line 2—2 in FIG. 1 and shows an installed transverse cross strip at a butt joint.
Figure 3:
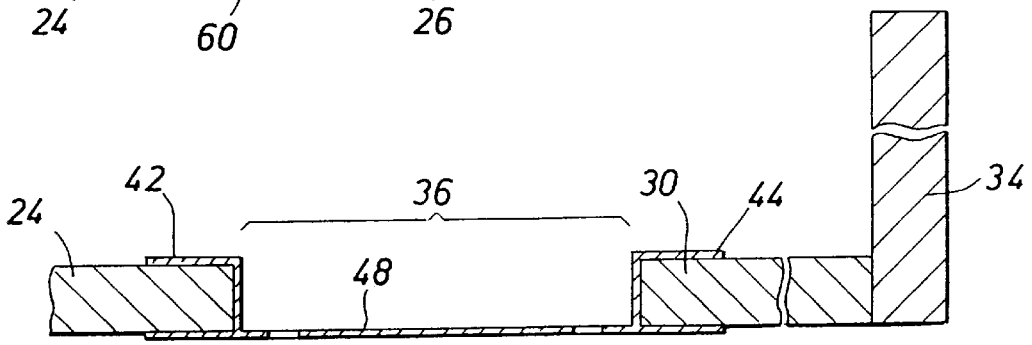
FIG. 3 is a sectional view along the line 3—3 of FIG. 1 and further illustrates details of construction of the assembled soffit and the bent strip which permits breathing of the attic space.

Attention is now directed to FIG. 3 of the drawings. There, the vent strip 110 is shown on the left hand side. This is a view looking up at the bottom of the soffit. The soffit, in this particular instance, is assembled with first and second soffit boards 140 and 144. The boards 140 and 144 collectively define the soffit which can extend the full length of the structure. Indeed, two, three or four similar boards can be arranged in butting relationship so that the soffit construction is consummated. The soffit, whether formed of one or several boards, is moved into the facing receptacle 120 along the edge of the vent strip 110. This is illustrated in FIG. 3. Without regard to the length of the vent strip 110 are the assembled soffit, proper and adequate length is obtained by this form of joining the components together. It is desirable that the gap between the boards 140 and 144 be closed. In the past, that has been closed with chalking. Chalking ultimately ages and becomes somewhat brittle. When that occurs, the gap between the boards 140 and 144 may bow open ever so slightly. Especially with wood, there may be some warpage or shrinkage. The present disclosure provides an enhanced protective strip as will be described.

FIG. 3 shows an enlarged view of the boards 140 and 144. They are closed at the gap between the two board with an H-shaped insert 150. The insert 150 is located between the two boards. It has a top face 152, and a bottom face 154. The two faces are joined by a central web 156. The web 156 is preferably as tall as the two boards so that it then defines left and right receptacles for the boards 140 and 144. It is located between the boards and has a length which is equal to the width of the soffit boards 140 and 144. It is desirable that it extend to the vent strip but not under it. In the region 156, the H-shaped member 150 is full length while the vent strip is cut only at the receptacle walls 122 and 124. The top and bottom exposed faces 152 and 154 both abut against the vent strip but do not create a ripple in or bulge under the vent strip.

While the foregoing is directed to the preferred embodiment, the scope thereof is determined by the claims which follow.

I claim:

1. A soffit located vent placed under an eave of a roof overhang on a building having an elongate inside full length soffit board formed of one or more boards serially affixed along an outside wall of the building, an outside soffit board parallel to the inside soffit board and comprised of one or more boards parallel to and spaced from the inside board wherein said inside and outside soffit boards define a gap therebetween having a specified length related to the length of the outside wall, said vent comprising a strip along the full length of said inside and outside soffit boards wherein said vent strip:

(a) has board engaging surfaces along parallel edges of said vent strip enabling engagement with said inside and outside soffit boards;

(b) is perforated to enable air circulation therethrough into a space above said vent strip and (c) is engaged with said inside and outside soffit boards at installation.

2. The apparatus of claim 1 wherein said vent strip is constructed with a board engaging surface comprising an edge located U-shaped receptacle.

3. The apparatus of claim 2 wherein said U-shaped receptacle has a length equal to that of said vent strip.

4. The apparatus of claim 1 wherein some board engaging surfaces form receptacles therealong to enable releasable engagement with said inside and outside soffit boards.

5. The apparatus of claim 4 wherein said vent strip has a uniform cross-sectional profile along the length thereof and is formed of an extruded vinyl material.

6. The apparatus of claim 4 wherein said vent strip has symmetrical left and right receptacles along said parallel edges and said receptacles have U-shaped openings therein to releasably engage the edges of said inside and outside soffit boards.

7. The apparatus of claim 1 wherein said inside soffit board is formed of two or more joints which form a butt joint and said butt joint supports an H-shaped cross strip having left and right receptacles therein engaging the boards of said inside soffit board.

8. The apparatus of claim 7 wherein said outside soffit board is formed of two or more joints which form a butt joint and said butt joint supports an H-shaped cross strip having left and right receptacles therein engaging the boards of said outside soffit board.

9. The apparatus of claim 8 wherein said cross strip has receptacles having a thickness sized to accommodate the thickness of boards comprising said inside soffit board.

10. The apparatus of claim 9 wherein said cross strip has receptacles having a thickness sized to accommodate the thickness of boards comprising said outside soffit board.

11. A soffit located vent under an eave of a roof overhang on a building having an elongate inside soffit board formed of one or more boards serially affixed along an outside wall of the building, an outside soffit board parallel to the inside soffit board and comprised of one or more boards parallel to and spaced from the inside board wherein said inside and outside soffit boards define a gap therebetween having a length up to the length of the outside wall, said vent comprising a continuous vent strip located between said inside and outside soffit boards wherein said vent strip:

(a) enables air circulation therethrough into a space above said vent strip;

(b) has an L-shaped board engaging surface along two parallel edges of said vent strip enabling engagement with said inside and outside soffit boards; and (c) is cut to the gap length.

12. The apparatus of claim 11 wherein said L-shaped board engaging surfaces of said vent strip are constructed with an edge located right angle surfaces engaging said inside and said outside soffit boards.

13. The apparatus of claim 12 wherein said L-shaped right angle surfaces have a length equal to that of said vent strip.

14. The apparatus of claim 13 wherein each of said L-shaped surfaces enable releasable engagement with said inside and outside soffit boards.

15. The apparatus of claim 14 wherein said vent strip has a uniform cross-sectional profile along the length thereof and is formed of an extruded vinyl material.

16. The apparatus of claim 14 wherein said vent strip has symmetrical left and right L-shaped right angle surfaces at said parallel edges and one of aid L-shaped right angle surfaces releasably engage the edges of said inside and outside soffit boards.

17. The apparatus of claim 11 wherein said inside soffit board is formed of two or more joints which form a butt joint and said butt joint is engaged with a H-shaped cross strip having left and right receptacles therein engaging the boards of said inside soffit board.

18. The apparatus of claim 17 wherein said outside soffit board is formed of two or more joints which form a butt joint and said butt joint supports an H-shaped cross strip having left and right receptacles therein engaging the boards of said outside soffit board.

19. The apparatus of claim 18 wherein said cross strip has receptacles having a thickness sized to accommodate the thickness of boards comprising said inside soffit board.

20. The apparatus of claim 19 wherein said cross strip has receptacles having a thickness sized to accommodate the thickness of boards comprising said outside soffit board.

21. A vent strip assembly under an eave of a roof overhang on a building having an elongate soffit board parallel to a wall of the buildings wherein the wall is covered with an outside surface veneer, and wherein said surface veneer is parallel to the elongate soffit board, and wherein said surface veneer is comprised of external veneer members parallel to and spaced from the elongate soffit board, and wherein said elongate soffit board and a topmost course of said surface veneer define a gap there between under an eave overhanging the wall of the building, said vent strip comprises a vent strip attached without fasteners between said elongate soffit board and said topmost course of said surface veneer, and wherein said vent strip is constructed with an edge located U-shaped receptacle to engage said U-shaped receptacle with said soffit board and a parallel topmost course engaging surface therealong enabling releasable engagement with said soffit board and said topmost course, and wherein said vent strip enables air circulation therethrough into a space above said vent strip.

22. The apparatus of claim 21 wherein said vent strip is constructed with an edge located U-shaped receptacle to engage said U-shaped receptacle with said soffit board.

23. The apparatus of claim 21 wherein U-shaped receptacle has a length equal to said vent strip.

24. The apparatus of claim 23 wherein said vent strip has two edges and one thereof supports said receptacle therealong to enable releasable engagement with said soffit board.

25. The apparatus of claim 24 wherein said vent strip has a uniform cross-sectional profile along the length thereof.

26. The apparatus of claim 24 wherein said vent strip has a second edge located L-shaped bracket to releasably engage an upper edge of said topmost course of said surface veneer.

27. The apparatus of claim 21 including an L-shaped bracket formed of two right angle members overlapping the upper edge of said veneer parallel to and spaced from said soffit board.

28. The apparatus of claim 27 wherein said soffit board is formed of two or more joints which form a butt joint and having a common thickness and said L-shaped bracket includes a right angle member having the same thickness.

29. The apparatus of claim 28 wherein said L-shaped bracket is formed of two members of equal width.

30. The apparatus of claim 29 wherein said L-shaped bracket is in length to said soffit board engaging means.

* * * * *